US006422111B1

(12) United States Patent
Rousseau

(10) Patent No.: US 6,422,111 B1
(45) Date of Patent: Jul. 23, 2002

(54) COMBINED GRADING AND TRIMMING METHOD FOR SAWMILL

(75) Inventor: William A. Rousseau, Bethel, VT (US)

(73) Assignee: Silvatech Corporation

( * ) Notice: Subject to any disclaimer, the term of this patent is extended or adjusted under 35 U.S.C. 154(b) by 0 days.

(21) Appl. No.: 09/414,957

(22) Filed: Oct. 12, 1999

Related U.S. Application Data

(60) Provisional application No. 60/122,092, filed on Feb. 26, 1999.

(51) Int. Cl.[7] ..... B26D 5/20

(52) U.S. Cl. ..... 83/35; 83/76.8; 83/13; 83/365

(58) Field of Search ..... 83/13, 35, 76.8, 83/76.7, 364, 365, 367, 425.2, 425.3, 425.4, 435.2, 437.2

(56) References Cited

U.S. PATENT DOCUMENTS

| | | | | | |
|---|---|---|---|---|---|
| 2,714,407 | A | * | 8/1955 | Pearson | 83/364 |
| 3,780,777 | A | * | 12/1973 | Davies | 143/3 N |
| 3,848,646 | A | * | 11/1974 | Miles | 144/3 N |
| 4,023,605 | A | | 5/1977 | Hellstrom et al. | |
| 4,120,333 | A | | 10/1978 | Hellgren et al. | |
| 4,164,248 | A | | 8/1979 | Rysti | |
| 4,333,373 | A | * | 6/1982 | Blickenderfer | 83/419 |
| 4,413,662 | A | * | 11/1983 | Gregoire et al. | 144/356 |
| 4,484,675 | A | | 11/1984 | Doherty et al. | |
| 4,702,134 | A | | 10/1987 | Corley, III | |
| 4,765,214 | A | * | 8/1988 | Nakaya | 83/80 |
| 4,805,679 | A | * | 2/1989 | Czinner | 144/357 |
| 4,839,816 | A | * | 6/1989 | Cattrall et al. | 83/367 |
| 4,934,228 | A | * | 6/1990 | Bolton et al. | 83/23 |
| 4,934,229 | A | | 6/1990 | Greten et al. | |
| 4,947,909 | A | * | 8/1990 | Stroud | 144/357 |
| 4,984,172 | A | * | 1/1991 | Luminari | 144/332 |
| 5,042,341 | A | | 8/1991 | Greten et al. | |
| 5,088,363 | A | * | 2/1992 | Jones et al. | 83/35 |
| 5,099,896 | A | * | 3/1992 | Ritola | 144/357 |
| 5,142,955 | A | * | 9/1992 | Hale | 83/75.5 |
| 5,249,491 | A | * | 10/1993 | Carter | 83/13 |
| 5,368,080 | A | * | 11/1994 | Hamel | 144/357 |
| 5,412,220 | A | * | 5/1995 | Moore | 144/357 |
| 5,605,216 | A | * | 2/1997 | Raybon et al. | 144/357 |
| 5,819,622 | A | * | 10/1998 | Quick | 83/365 |
| 5,853,038 | A | * | 12/1998 | Newnes | 144/357 |
| 5,950,517 | A | * | 9/1999 | Yoder | 83/708 |
| 6,199,463 | B1 | * | 3/2001 | Qucik | 83/13 |
| 6,240,821 | B1 | * | 6/2001 | Landers et al. | 83/364 |

* cited by examiner

*Primary Examiner*—M. Rachuba
*Assistant Examiner*—Kim Ngoc Tran
(74) *Attorney, Agent, or Firm*—Sughrue Mion, PLLC

(57) ABSTRACT

A method of combining the grading and trimming operation of a board to thereby eliminate the position of a trimmer, includes feeding a board having two sides to a turn assembly with a first side of its two sides upright, grading the first side of the board, moving the board longitudinally using belt, chain, or rollers, turning the board such that the second side of the board is upright and grading the second side of the board, moving the board in a longitudinal direction using a roll case, to position the board in a position for trimming, and feeding the board to a trimmer to be cut. A sloped turn assembly or flat transfer assembly can be used to turn the board for inspection.

15 Claims, 4 Drawing Sheets

COMBINED GRADING AND TRIMMING METHOD FOR SAWMILL

CROSS-REFERENCE TO RELATED APPLICATIONS

This application is an application filed under 35 U.S.C. §1.111(a) claiming benefit pursuant to 35 U.S.C. §119(e)(1) of the filing date of the Provisional Application No. 60/122,092 filed Feb. 26, 1999, pursuant to 35 U.S.C. §111(b).

BACKGROUND OF THE INVENTION

1. Field of the Invention

The present invention relates to a method of operation of a sawmill or lumber processing facility, wherein the grading and trimming operations are combined, which permits the grader to perform the function of the trimmer operator, thus, eliminating the position of the trimmer operator.

2. Description of the Related Art

In conventional sawmills, a grader works in an area ahead of the trimmer, marking boards for grade and to indicate where on the boards a cutback is required and the ends of the board are to be cut off. A cut back is typically required if a board has excessive wane of defects near the end or ends of the board.

After grading, each board proceeds to the trimmer, and the trimmer operator moves the boards which must be cut back endwise such that the desired cut points are at the saw lines. The trimmer operator also selects the trim saws to be used on the board.

Saws are typically placed at 0 ft., 1 ft., 4 ft., 6 ft., 8 ft., 10 ft., 12 ft., 14 ft., and 16 ft., from an index line. They may extend to 18 ft., 20 ft., etc. A board to be trimmed 12 ft., will be cut by the 0 ft. and 12 ft. saws. A board to be trimmed to 9 ft. will be cut by the 1 ft. and 10 ft. saws.

A drop saw or jump saw trimmer has saws at fixed positions which are lowered (in the case of a drop saw), or raised (in the case of a jump saw), to make the cross cuts to trim the board. A "moving saw" trimmer has a fixed saw at one end and a moving saw which typically strokes from 4 ft. to 16 ft. (from the fixed end).

In any of these three types of trimmer saws, boards which require cut back must be moved endwise (i.e., lengthwise) in relation to the saws to remove the desired amount.

Conventional grading and trimming operations are disclosed by Greten et al, U.S. Pat. No. 4,934,229, Greten et al, U.S. Pat. No. 5,042,341, Hellgren et al, U.S. Pat. No. 4,120,33, Rysti, U.S. Pat., No. 4,164,248, and Hellström et al, U.S. Pat. No. 4,023,605.

Doherty et al, U.S. Pat. No. 4,484,675, disclose a conventional board turned apparatus and method, wherein a board can be turned several times for repeated inspection of both sides of the board for more accurate grading.

However, all the above references suffer from the disadvantage that a trimmer operator is required, and since the position of a trimmer operator is difficult to fill due to, at the very least, the repetitive nature of the job, the mechanization of as much as possible of the grading and trimming operations is necessary.

SUMMARY OF THE INVENTION

The object of the present invention is to provide a method of sawmill or lumber processing operation, wherein the grader and trimmer positions are combined, so that the grader performs the function of the trimmer operator, thus, eliminating the position of the trimmer operator.

In a first embodiment of the present invention, the method of grading and trimming a board or other structure having two sides includes feeding the board to a sloped turn assembly with a first side of its two sides upright, grading the first side of the board if cutback is desired, moving the board in a longitudinal direction to position the board for trimming, pivoting the board using the sloped turn assembly such that the board falls onto a roll case with a second side of the two sides upright, grading the second side of the board, and if cutback is desired, moving the board in a longitudinal direction to position the board for trimming, feeding the board to a trimmer, and cutting the board.

In a second embodiment of the present invention, the sloped turn assembly is replaced with a flat transfer assembly which can turn the board onto both sides for grading. If a cutback is indicated, the roll case is raised to move the board in a longitudinal direction to a position for trimming.

BRIEF DESCRIPTION OF THE DRAWINGS

Other features and advantages of the invention will be apparent from the following description taken in connection with the accompanying drawings, wherein.

DETAILED DESCRIPTION OF THE PREFERRED EMBODIMENTS

The present invention relates to a method of mechanizing movement of a board endwise at either of two positions in a grading station to position the board properly to be processed by an end trimmer. Thus, the grader performs the function of the trimmer operator, and the position of the trimmer operator is obviated.

Figure 1:
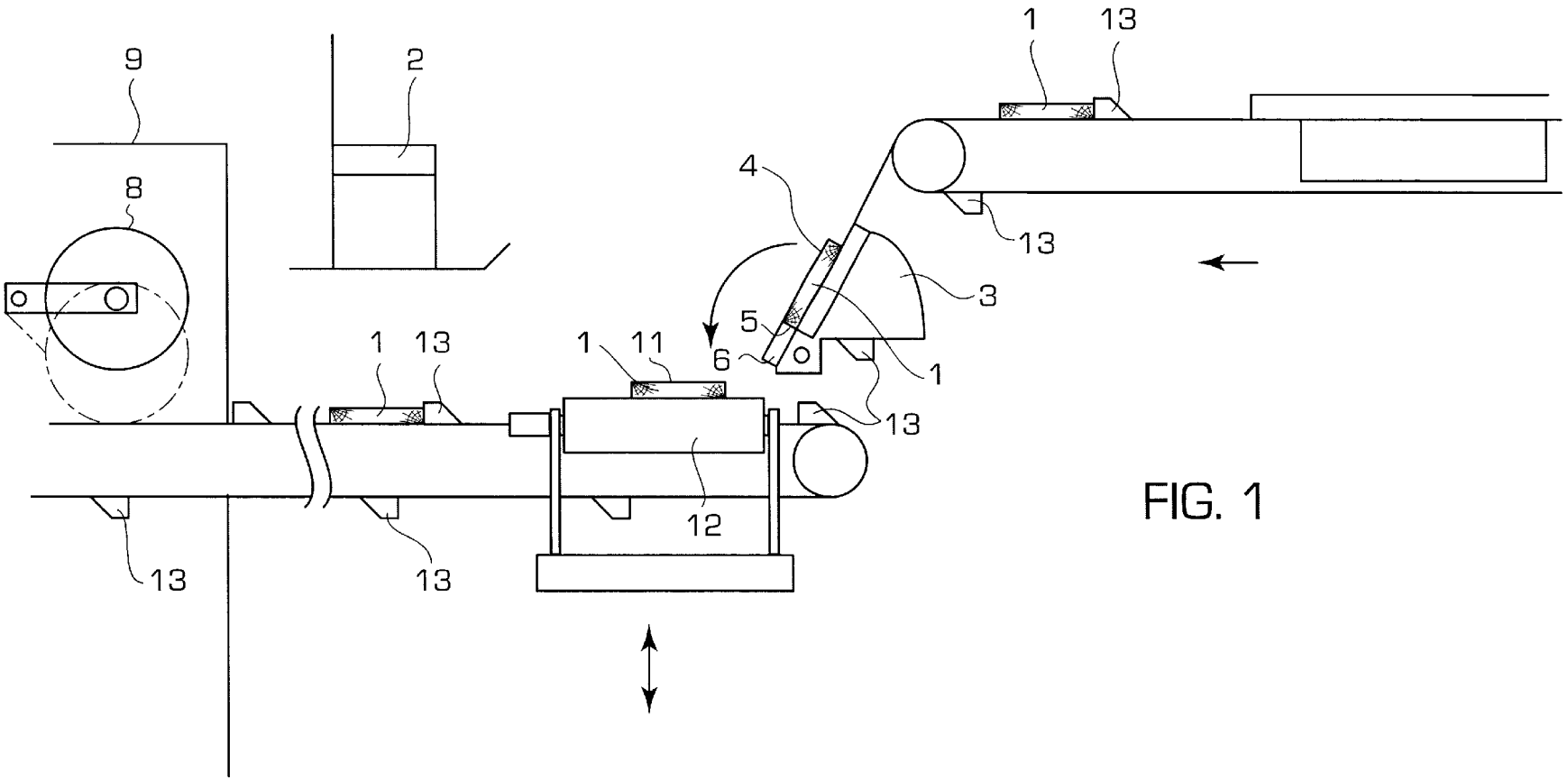
FIG. 1 shows a side view of the grading and trimming operation of a sawmill or lumber processing operation, according to a first embodiment of the present invention.

In the sawmill operation of a first embodiment of the present invention, as shown in FIG. 1, after the boards 1 are measured by conventional means, the boards 1 approach a grading station 2 on a lugged chain and are even ended such that one end of the board 1 extends slightly beyond the 0 ft. saw reference line. The boards 1 are then stopped, and fed one at a time into the grading station 2.

Figure 2:
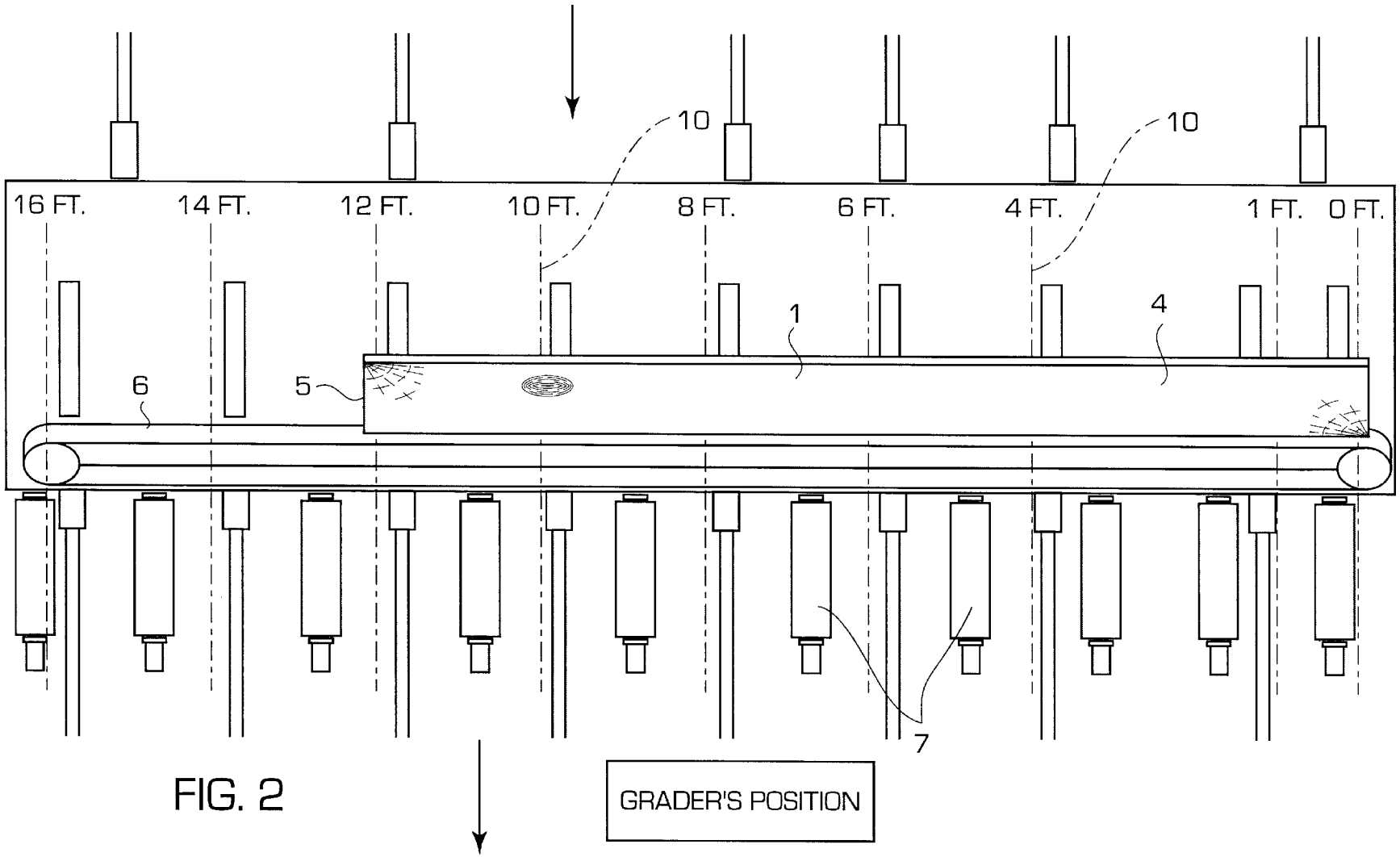
FIG. 2 shows an overhead view of a board on a sloped turn assembly according to a first embodiment of the present invention.

Each board 1 is then fed down at an angle onto a sloped turn assembly 3, as shown in FIG. 2, where a grader working at the grading station 2 views the first face 4 of the board 1 as its edge 5 rests on the conveying belt 6 of the turn assembly 3. (The belt 6 could alternatively be a chain or series of rollers 7 (see FIG. 2)). Either side of the board 1 may exhibit defects which justify cutback.

The position of each saw 8 in the trimmer 9 is displayed as a reference line on the grading station 2, or alternatively, by a projected laser line 10 running across the board 1 at 0 ft., 1 ft., 4 ft., 6 ft., 8 ft., 10 ft., 12 ft., 14 ft., and 16 ft. increments (see FIG. 2), on the turn assembly 3. If the face 4 now viewed has defects requiring cut back, the grader can select the saws 8 to be used by pressing buttons at the grading station 2, and also by moving the board 1 endwise (i.e., longitudinally) by controlling the conveyor belt 6 via foot pedals or hand controls (not shown), to position the board 1 such that the best quality portion of the board 1 falls between the selected saws 8. The buttons (not shown) used to select saws 8 are interfaced to a computer or other controller (not shown) which registers the saw selections for the board 1 for use when the board 1 arrives at the trimmer 9. The computer (not shown) may be part of a tally system which measures the boards 1 for length, width, and thickness, and records a grade inputted by the grader.

Figure 3:
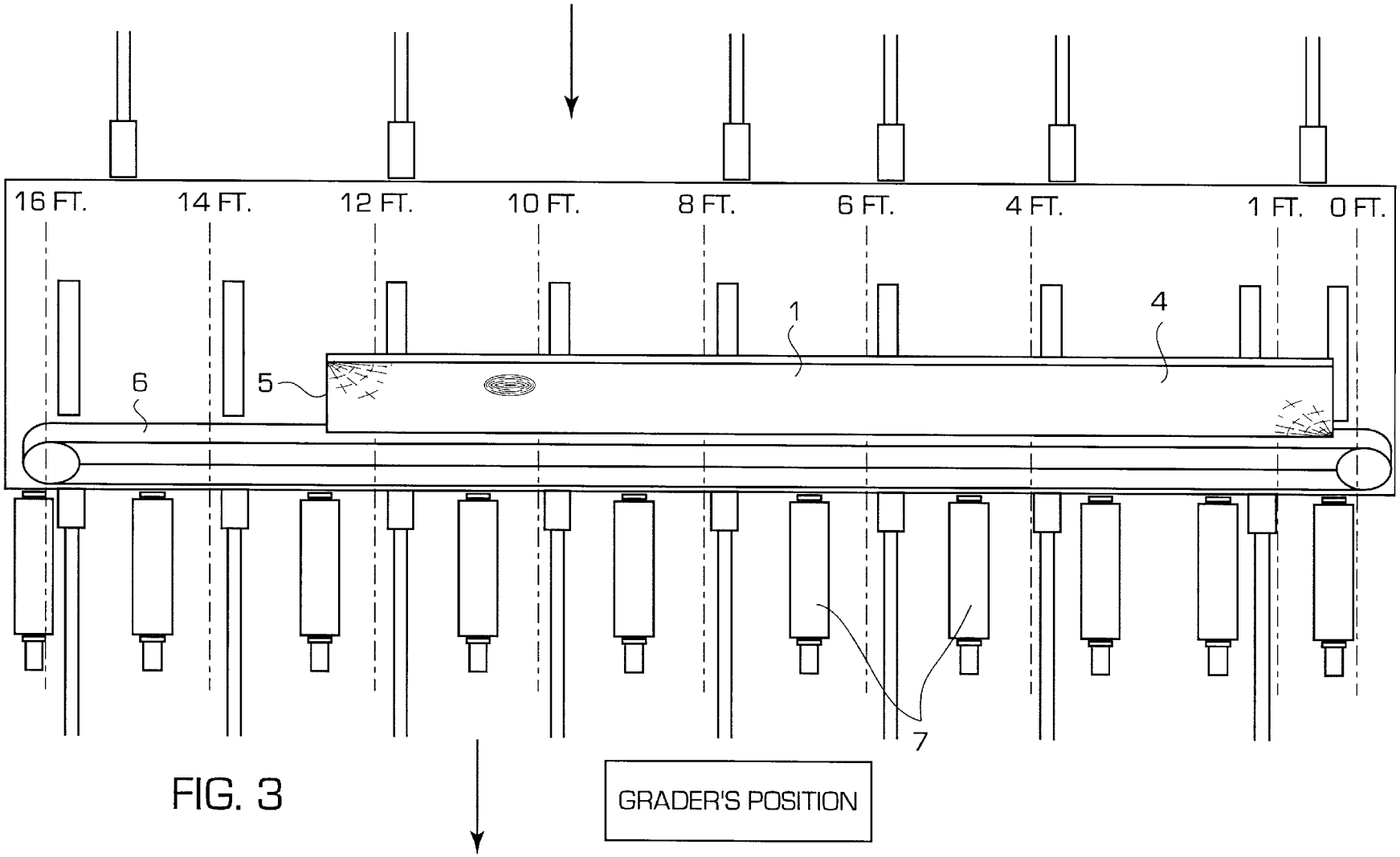
FIG. 3 shows another overhead view of a board on a sloped turn assembly according to a first embodiment of the present invention.

As an example, FIG. 2 shows a 12 ft. board 1 at its initial position in the grading operation on the turn assembly 3. If the grader decides to trim the board 1 back to 9 ft., this will require the 1 ft. and the 10 ft. saws. Therefore, the grader activates the belt 6 in the turn assembly 3 to move the board 1 such that the 1 ft. and 10 ft. saws 8 will now fall in the proper locations on the board 1 to remove the unwanted defects (see FIG. 3).

If the board 1 does not need to be cut back, the computer (not shown) automatically prepares to cut the board 1 to the next even length, in one foot increments.

When ready to view the reverse side 11 of the board 1, the grader presses the turn button or pedal (not shown) which causes the turn assembly 3 to rotate forward endwise and the board 1 to pivot on its longitudinal edge 5, and to fall onto the roll case 12 to display its other side 11. If the view of the reverse side 11 of the board 1 dictates a cut back, the board 1 can be moved endwise (i.e., longitudinally) with respect to the saw reference lines 10.

Displayed across the grading station 2 are either marks or laser light lines (not shown) which indicate the positions of the trimmer saws 8 which await the board 1 further downstream. The grader can thus, see where cross cuts would be made by the various saws 8 in the trimmer 9. The grader may select a trim solution and then shift the board 1 to one side or the other (the board moving lengthwise or longitudinally), by controlling the roll case 12.

When the board 1 is properly positioned on the roll case 12, the grader presses a "release" button (or a grade button if a tally system), such that the board 1 is graded and released to the trimmer 9. At the first opportunity, when a lug 13 is not under the board 1 on the roll case 12, the roll case 12 is lowered (or the chain raised), placing the board 1 in front of a known lug 13. The passing of lugs 13 is monitored by the computer or controller (not shown) and when the lug 13 with this board 1 arrives at the trimmer 9, the computer instructs the trimmer control (not shown) to activate the selected saws 8 (or position the moving saw in that type of trimmer).

Figure 4:
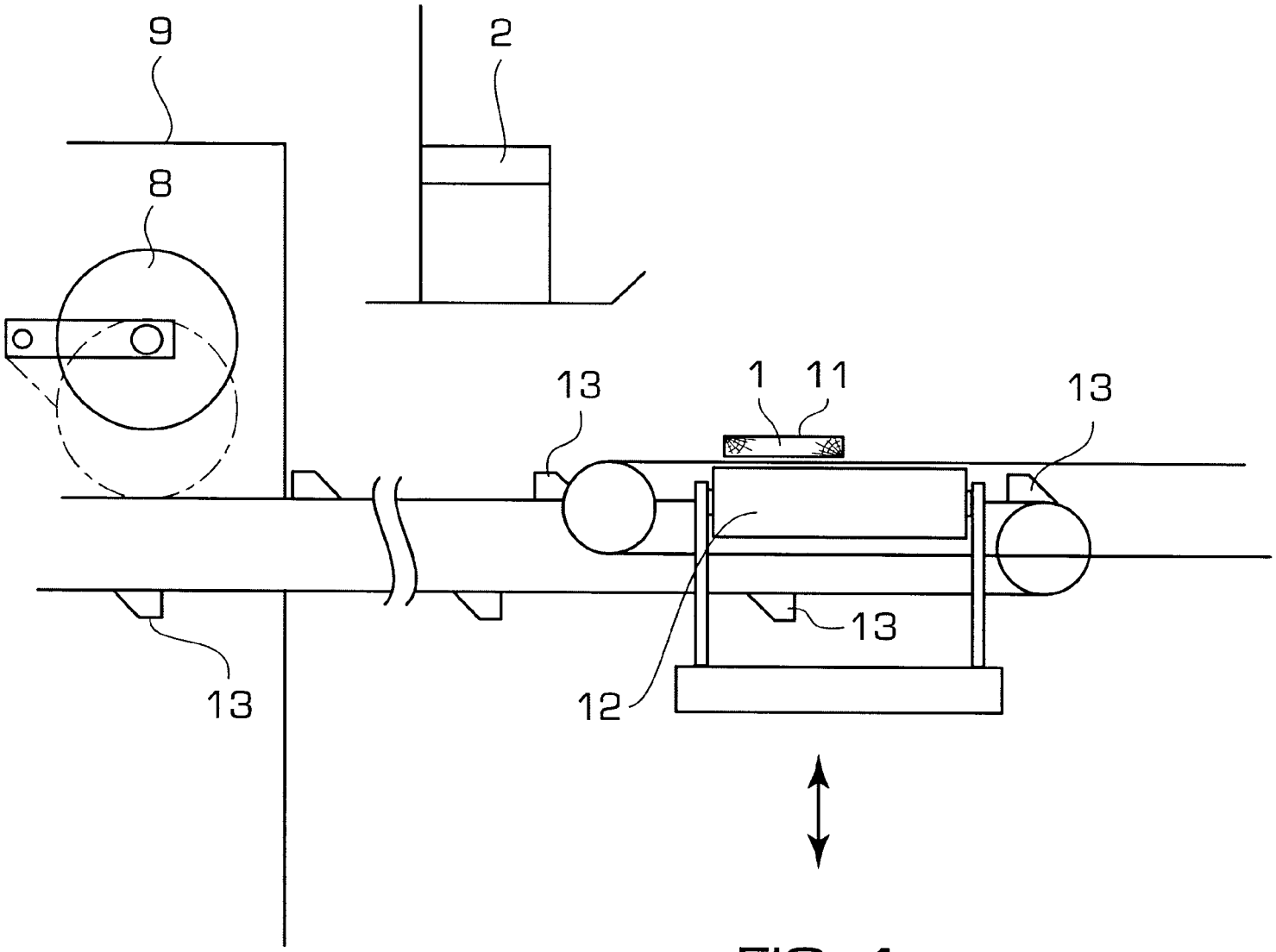
FIG. 4 shows a side view of the grading and trimming operation of a sawmill according to a second embodiment of the present invention.

In a second embodiment of the present invention, a conventional flat grading station 14 can be used instead of a sloping turn assembly 3 grading station, by the grader (see FIG. 4).

In this embodiment, each board 1 is moving along a flat transfer or deck 14 consisting of multiple strands of driven chain. The board 1 arrives at the grading station 2 in the view of the grader, at which position the grader can turn the board 1 to inspect both sides via a conventional board turner apparatus 14, as described for example, in Doherty et al, U.S. Pat. No. 4,484,675. Doherty et al disclose a board turner apparatus and method, wherein a board can be turned several times for repeated inspection of both sides of the board for more accurate grading.

In this embodiment, the board 1 is moved to the grading station 2 by a flat (unlugged) chain deck. The board 1 is turned at the position above the roll case 12. If the board 1 is to be cut back, the roll case 12 is lifted and activated to move the board to the trim position (i.e., longitudinally) by the grader. When the release or grade button is pressed by the grader, either the flat top chain and rollcase 12 are lowered, or the lug chain is raised to load the board 1 onto a predetermined lug for feeding to the trimmer. Alternatively, the board 1 could exit the grading station on the flat chain and proceed to a lug loader station (not shown) in preparation for feeding into the trimmer.

The above side shifting device used to position boards 1 properly for trimming can also be used to move boards 1 lengthwise out of the grading area to either side into a bin or onto another conveyor to be reprocessed or for sorting out culls, etc.

Thus, the present invention automates the trimming operation by combining the grading and trimming functions, thus providing for the elimination of a trimmer operator.

The present invention can be used in other inspection and cutting operations other than for boards in a sawmill.

It is contemplated that numerous modifications may be made to the apparatus and procedure of the invention without departing from the spirit and scope of the invention as defined in the following claims.

What is claimed is:

1. A method of optimizing the value of a finally trimmed board, the method comprising the steps of:

providing reference lines indicative of respective cutting positions of saws, pairs of the reference lines corresponding to selectable trim settings for cutting off both ends of the board;

positioning a board, as yet untrimmed in the current stage of the production process, across the reference lines;

selecting a first trim setting as the pair of reference lines which are spaced furthest apart and across which the board extends;

inspecting a first face of the board for defects while the board is positioned across the reference lines, and if unwanted defects are present on the first face which are positioned between the reference lines corresponding to the first trim setting, then (1) selecting a second trim setting that is shorter than the first trim setting, and (2) moving the board relative to the reference lines so that the unwanted defects on the first face are not positioned between the pair of reference lines corresponding to the second trim setting;

inspecting a second face of the board for defects while the board is positioned across the reference lines, and if unwanted defects are present on the second face which are positioned between the reference lines corresponding to one of the first trim setting and the second trim setting, then (1) selecting a third trim setting that is shorter than one of the first trim setting and the second trim setting, and (2) moving the board relative to the reference lines so that the unwanted defects on the second face are not positioned between the pair of reference lines corresponding to the third trim setting; and cutting off both ends of the board at a shortest selected one of the first, second, and third trim settings, thereby eliminating a need for multiple operators.

2. The method according to claim 1, further comprising the step of:

projecting laser beams to provide the reference lines.

3. The method according to claim 1, further comprising the step of:

turning the board over after inspecting the first face and before inspecting the second face.

4. The method according to claim 1, wherein the moving step includes moving the board in a longitudinal direction of the board.

5. The method according to claim 1, further comprising the step of:

measuring the length of the board; and determining the first trim setting based on the measured length of the board.

6. The method according to claim 1, wherein all of the steps are performed by only one operator using remote controlled devices.

7. A method of optimizing the value of a finally trimmed board having two sides using a control system, said method comprising the steps of:

(a) feeding a board, as yet untrimmed in the current stage of the production process, to a sloped turn assembly with a first side of said two sides upright;

(b) grading said first side of said board;

(c) moving said board using said turn assembly in a longitudinal direction of said board to position said board in a first predetermined position;

(d) pivoting said board on a longitudinal edge extending between said two sides using said sloped turn assembly, such that said board falls onto a roll case with a second side of said two sides upright;

(e) grading said second side of said board;

(f) moving said board in the longitudinal direction to position said board in a second predetermined position; and (g) feeding said board to a trimmer to cut both ends of said board;

wherein steps (b), (e), and (g) are performed in sequential order, thereby eliminating a need for multiple operators.

8. A method of optimizing the value of a finally trimmed board having two sides using a control system, said method comprising the steps of:

(a) feeding a board, as yet untrimmed in the current stage of the production process, to a flat transfer assembly with a first side of said two sides upright;

(b) grading said first side of said board;

(c) turning said board using said flat transfer assembly such that a second side of said two sides of said board is upright;

(d) grading said second side of said board;

(e) feeding said board to a roll case;

(f) moving said board in a longitudinal direction of said board on said roll case, to position said board in a predetermined position; and (g) feeding said board to a trimmer to cut both ends of said member;

wherein steps (b), (d), and (g) are performed in sequential order, thereby eliminating a need for multiple operators.

9. A method of optimizing the value of a finally trimmed member having two sides using a control system, said method comprising the steps of:

(a) feeding a member, as yet untrimmed in the current stage of the production process, to a turn assembly with a first side of said two sides upright;

(b) inspecting said first side of said member;

(c) moving said member in a longitudinal direction of said member using said turn assembly to position said member in a first predetermined position;

(d) turning said member using said turn assembly such that said member is disposed with a second side of said two sides upright on a moving assembly;

(e) inspecting said second side of said member;

(f) moving said member in the longitudinal direction using said moving assembly to position said member in a second predetermined position; and (g) feeding said member to a cutter, to cut both ends of said member;

wherein steps (b), (e), and (g) are performed in sequential order, thereby eliminating a need for multiple operators.

10. The method according to claim 9, wherein steps (b) and (c) are performed in sequential order.

11. The method according to claim 9, wherein said turn assembly is a sloped turn assembly.

12. The method according to claim 9, wherein said turn assembly is a flat transfer assembly.

13. The method according to claim 9, wherein said moving assembly is a roll case.

14. The method according to claim 9, wherein said member is a board and steps (b) and (e) include grading said board.

15. The method according to claim 9, wherein said cutter is a saw.

* * * * *